United States Patent [19]

Schepers

[11] Patent Number: 5,011,622

[45] Date of Patent: Apr. 30, 1991

[54] LIQUID CLEANING COMPOSITIONS AND PROCESS FOR THEIR PREPARATION

[75] Inventor: Frederik J. Schepers, Vlaardingen, Netherlands

[73] Assignee: Lever Brothers Company, Division of CONOPCO, Inc., New York, N.Y.

[21] Appl. No.: 418,048

[22] Filed: Oct. 6, 1989

[30] Foreign Application Priority Data

Oct. 10, 1988 [GB] United Kingdom ..... 8823705

[51] Int. Cl.[5] ..... C11D 3/08; C11D 7/54; B08B 7/02; B08B 5/00

[52] U.S. Cl. ..... 252/174.15; 252/8.6; 252/95; 252/99; 252/135; 252/174.25; 252/DIG. 14; 252/139; 252/523; 134/17; 134/31; 134/19

[58] Field of Search ..... 252/95, 99, 135, 174.25, 252/DIG. 14

[56] References Cited

U.S. PATENT DOCUMENTS

| | | | |
|---|---|---|---|
| 4,264,466 | 4/1981 | Carleton et al. | 252/99 |
| 4,690,771 | 9/1987 | Ouhadi et al. | 252/102 |
| 4,743,394 | 5/1988 | Kaufmann et al. | 252/90 |
| 4,769,168 | 9/1988 | Ouhadi et al. | 252/99 |

FOREIGN PATENT DOCUMENTS

| | | |
|---|---|---|
| 266199 | 5/1988 | European Pat. Off. . |
| 61616 | 4/1982 | Japan . |
| 1473201 | 5/1977 | United Kingdom . |
| 1498492 | 1/1978 | United Kingdom . |
| 1514522 | 6/1978 | United Kingdom . |
| 2018232 | 10/1979 | United Kingdom . |

OTHER PUBLICATIONS

Breck et al., Journal of the Amer. Chem. Soc., 78(23): 5963–5971 (1956), Especially Figure 11 on p. 5969.

*Primary Examiner*—Paul Lieberman
*Assistant Examiner*—Kevin McCarthy
*Attorney, Agent, or Firm*—Ronald A. Koatz

[57] ABSTRACT

In non-aqueous liquid cleaning products compositions comprising dispersed particles of aluminosilicate builder, components sensitive to decomposition catalyzed by aluminosilicate, such as bleach precursors, can be protected if the aluminosilicate particles are deactivated by pre-treatment with an ammonium or substituted ammonium compound, followed by a heating step to reduce the water level of the aluminosilicate.

17 Claims, No Drawings

LIQUID CLEANING COMPOSITIONS AND PROCESS FOR THEIR PREPARATION

The present invention is concerned with substantially non-aqueous liquid cleaning compositions of the kind comprising dispersed particles of aluminosilicate builder and one or more other components having a sensitivity to decomposition caused by catalytic action of the aluminosilicate. It also extends to a process of preparing such compositions.

Substantially non-aqueous liquid cleaning compositions are those comprising little or no water, e.g. 5% by weight or less. They comprise a liquid phase which is composed of a liquid surfactant, another non-aqueous liquid or a mixture thereof. When an aluminosilicate builder is incorporated, it is present as dispersed particles. Other components may also be present, either as dispersed particles or dissolved in the liquid phase. Particles are maintained as a dispersion by virtue of their small size and the viscosity of the liquid phase (i.e. as governed by Stokes' law), by the van der Waals attractive forces between the small particles, and/or by the action of a dispersant incorporated for that purpose.

The aluminosilicate is used in cleaning compositions as a builder, i.e. to counter the effects of calcium ion water hardness in the wash. However, outside the cleaning/detergent field, it is also well known that aluminosilicates can be used as non-specific catalysts for a wide variety of chemical reactions.

We have found that the presence of aluminosilicate particles in such non-aqueous liquid compositions can lead to severe problems when certain other components are also present, namely decomposition which can be said to be catalysed by the aluminosilicate in that it does not occur (or occurs to a much lesser extent) when the aluminosilicate is not present.

Surprisingly, we have now also found that such decomposition is inhibited if the aluminosilicate particles are pretreated in a specified manner. Thus, according to the invention there is provided a non-aqueous liquid cleaning composition comprising a liquid phase having a particulate solid phase in the form of an aluminosilicate builder dispersed therein, characterised in that the aluminosilicate particles have been deactivated by treatment thereof with an ammonium or substituted ammonium compound and thereafter heating to reduce the water content thereof to below 24% by weight and dispersing in the liquid phase.

In the literature of catalytic chemistry it is known to pre-treat aluminosilicates with an ammonium compound to create acidified catalysts for reforming branched hydrocarbons, in the petroleum industry, for enhancing octane yields. For example, see Breck D. W. and Flanigen E. M. in 'Molecular Seives', pp.47–61, Soc. Chem. Industry, London, 1968. However there is no suggestion that such a pre-treatment could inhibit their ability to catalyse decomposition of components in non-aqueous liquid detergents.

The kinds of problem encountered with the aluminosilicates are believed typically to occur along the following lines, although the precise mechanism by which the present invention provides the solution is not clear.

When particulate aluminosilicate is added to a non-aqueous liquid medium, an initial release of gas from the particles is observed for several hours. This could be due to the escape of gas trapped in the highly porous surface of the aluminosilicate. However, once such escape has ceased, there is no longer a problem. Nevertheless, there can be further difficulties when an aluminosilicate-sensitive component is present.

A common aluminosilicate-sensitive component is a dispersed particulate oxygen bleach system comprising an inorganic persalt and a bleach precursor. Such systems are well known to those skilled in the art. They function by release of hydrogen peroxide from the peroxygen compound when in contact with water, e.g. in the wash. The hydrogen peroxide reacts with the precursor to form a peroxyacid as an effective bleach. The use of the activator thus makes bleaching more effective at lower temperatures.

The aluminosilicate causes profound gassing in the presence of the inorganic persalt, for example sodium perborate, monohydrate or tetrahydrate. This is probably due to release of oxygen and so effectively reduces the bleach capacity of the product. Moreover, when certain dispersants for the particles are used, the evolved gas can be suspended, forming a mousse of unacceptably high viscosity.

Whilst the degree of this decomposition is partly dependent on the nature of the liquid phase, in particular the kind of any nonionic surfactant therein, we have also found that the amount of water present in the aluminosilicate particles has a profound effect. Here it is convenient to define three levels of water (degrees of hydration) for the aluminosilicates, e.g. for 4A zeolite. These can be termed 'fully hydrated', corresponding to about 24% of water by weight of the aluminosilicate which is approximately the maximum theoretical water level, 'partially hydrated', corresponding to about 18% by weight of water and 'activated', corresponding to about 4%–6% by weight of water. In the latter case the water seems to be bound to the aluminosilicate and cannot be driven off without significant loss in building performance. The amount of water may therefore represent the maximum amount of dehydration which may be achieved.

It is an essential feature of the invention that the treated aluminosilicate is heated to reduce the water content thereof to below 24%, preferably to not more than 18% by weight. The heating step will normally take place before the treated aluminosilicate particles are dispersed in the liquid phase.

In European patent specification EP-A-266 199 (Unilever), it is stated that initial gassing due to trapped gas and undesired setting are worsened by increased water levels in the aluminosilicate. Although not fully understood, it may be that the gassing and setting initiated by the water are mitigated or stopped because the heating step reduces the water content.

However, more significantly, aluminosilicates also promote decomposition of the precursor in a bleach/precursor system. The precursors are often acetic acid esters (e.g. glyceryl tri-acetate or N, N, $N^1$, $N^1$-tetraacetyl ethylene diamine, otherwise known as TAED). Decomposition of the precursor is measurable by a titration technique and clearly is a major factor which will degrade the bleaching capability of the product.

Without wishing to be bound by any theory, the applicants believe that treatment with an ammonium compound brings about an ammonium ($NH_4^+$)/sodium($Na^+$) ion exchange in the aluminosilicate, leaving it acidic relative to the untreated zeolite. Heating removes traces of any water or other solvent used in the treatment and if sufficient, also may strip some or all of the ammonium ions to leave protonated surface sites, which are also relatively acidic.

The aluminosilicates which are to be incorporated when pre-treated, are for example, crystalline or amorphous materials which before the pretreatment have the general formula $$Na_Z(AlO_2)_Z(SiO_2)_Y x\ H_2O$$

wherein Z and Y are integers of at least 6, the molar ratio of Z to Y is in the range from 1.0 to 0.5, and x is an integer from 6 to 189 such that the moisture content is from about 4% to abut 20% by weight. Our preferred aluminosilicate material is zeolite A in which the $Na^{+}/Al^{+++}$ is theoretically 1:1, although in practice this may be 1.05:1 or higher due to the presence of excess alkali, and the aluminum to silicon ratio is approximately 1:1.

The preferred range of aluminosilicate is from about 12% to about 30% on an anhydrous basis. The aluminosilicate preferably has a particle size of from 0.1 to 100 microns, ideally between 0.1 and 10 microns and a calcium ion exchange capacity of at least 200 mg calcium carbonate/g.

The acidification by treatment with an ammonium compound contrasts with treatment using ammonia gas which is basic in character. The latter has been found to make the aluminosilicate even more prone to catalyse decomposition of sensitive components.

The ammonium compound used may be a simple inorganic salt such as the chloride or sulphate, or an organic salt such as the citrate. In the context of the present invention, 'ammonium compounds' also embraces compounds wherein the ammonium ion is substituted, especially quaternary ammonium salts, especially where the cation is sufficiently small to be able to enter the pores of the aluminosilicate material.

Preferably, the aluminosilicate is immersed in a solution of the ammonium compound in a suitable solvent such as water, then washed, preferably with the same solvent, to remove at least part of the by-products of the treatment reaction and dried either before or simultaneously with the heating step. With ammonium compounds capable of sublimation, it may be possible to expose the aluminosilicate to the subliming vapour. The very best results are obtained by subsequently heating the treated material at from 201° to 750° C., preferably from 400° C. to 450° C. The latter is thought to result in stripping substantially all of the ammonium ions with consequent protonation. However, good results may still be obtained by heating at from 100° C. to 200° C. This is thought to leave residual surface $NH_4^+$ species. Typical heating times are in the order of 4 hours at atmospheric pressure although as little as 1 hour may be sufficient. Below 150° C., e.g. at 120° C. and lower, the performance of the treated aluminosilicate falls off. It is a particular advantage of the present invention that treated aluminosilicate particles can be more easily dried than the corresponding untreated material.

When the aluminosilicate is treated by immersion in a solution of the ammonium compound, the molar ratio of ammonium ions in the solution, relative to the sodium ions in the added aluminosilicate, is also important. A typical working solution is 0.2M aqueous ammonium chloride. Varying the amount of added zeolite to vary the mole ratio gives a useful range of about 0.05:1 to about 0.8:1 corresponding to a percentage mole exchange of ammonium ions for sodium ions of 1% to 38%. Although greater exchange, say 50% to 60%, may be possible by using ratios around 2.0:1 to 2.4:1, that is not favourable for acidic deactivation.

The reader's attention is directed to Breck et al., J.A.C.S. 78, 23 especially FIG. 11 thereof, for further details of this process.

Thus where the starting aluminosilicate material is zeolite A, or an equivalent thereof with a $Na^{+}/Al^{+++}$ ratio of 1:1, the treatment preferably leads to a final ratio of from 0.62:1 to 0.99:1, the balance to a molar ratio of 1:1 being made up of ions selected from ammonium, substituted ammonium and hydronium ions.

The altered nature of the deactivated aluminosilicate in the composition may be detected by filtering off and washing the aluminosilicate and measuring the sodium/aluminum ratio by conventional analytical technique. This ratio should be reduced in sodium relative to the value for the untreated material. For material where substantially all the exchanged ammonium ions have been stripped, the altered state may be detected by infra-red analysis of the filtered and washed material For filtered and washed material containing a substantial $NH_4^+$ residue, analysis may be performed by vigorous heating and detecting the ammonium ions released. In some cases, the acidified nature of the material might be identifiable by measuring the pH of an aqueous dispersion.

In the compositions according to the present invention, it is preferred that the average particle size of all dispersed solids is 10 microns or less. If the solids are not already suitably small, they can be reduced to the required size by milling They can be milled prior to dispersion in the liquid phase or they can be milled after mixing with the liquid phase (e.g. in a colloid mill). Even if some or all of the particles are already sufficiently small, they can be passed through a mill after mixing with the liquid phase, in order to improve homogeneity of the composition. It is also possible to mill some solids before mixing with the liquid phase and some afterwards.

Preferably, and especially when in the solid phase, the sensitive components are dispersed in the liquid phase simultaneously with or subsequent to the dispersion of the treated aluminosilicate, and then optionally at least partly size reduced by milling.

Thus, when the sensitive components comprise an oxygen bleach system of the kind hereinbefore described, to maximise inhibition of gassing, it is preferred that at least the persalt and the treated aluminosilicate are dispersed in the liquid phase (most preferably also with the bleach precursor) and then passed through a mill. When the composition also contains further ingredients, especially other solid phase ingredients, it is most preferred that substantially all solid phase ingredients are dispersed in the liquid phase and then milled. These requirements apply even when some or all of the solids are already sufficiently small and/or have been milled previously.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In the aforementioned most preferred process, the dry, substantially anhydrous solids are blended with the liquid phase in a dry vessel. This blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

It may also be desirable to de-aerate the product before addition of any heat sensitive ingredients. Although in the most preferred process, all components are passed through the mill, sometimes it may be convenient to add certain highly heat sensitive components (usually minor) after milling and a subsequent cooling step. Typical heat sensitive ingredients which might be added at this stage are perfumes and enzymes, but might also include highly temperature sensitive bleach components or volatile components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

Although liquid cleaning compositions according to the present invention need not contain a surfactant, it is envisaged that in many embodiments they will. These surfactant compositions are liquid detergent products, e.g. for fabric washing, machine warewashing or hard surface cleaning (with or without abrasives). However, the wider term 'liquid cleaning composition' also includes non-surfactant liquids which are still useful in cleaning, for example non-aqueous bleach products or those in which the liquid phase consists of one or more light, non-surfactant solvents for greasy stain pre-treatment of fabrics prior to washing. Such pre-treatment products can contain in addition to the aluminosilicate builder, solid bleaches, dispersed enzymes and the like. The liquid cleaning compositions according to the invention may also be in the form of specialised cleaning products, such as for surgical apparatus or artificial dentures. They may also be formulated as agents for washing and/or conditioning of fabrics.

Although it is possible to control the rheology of the product, both on storage and in dispensing, by virtue of the particle size, as mentioned above and in patent specifications EP-A-30 096 (ICI) or GB 2 158 838 A (Colgate-Palmolive), it is preferred to include one or more agents specifically included for that purpose. Most preferably, these are chosen from the deflocculant materials disclosed in the aforementioned EP-A-266 199. Preferred examples of these deflocculants are alkyl benzene sulphonic (free) acids such as dodecyl benzene sulphonic acid (ABSA), or lecithin.

However, alternatively or in addition, it is possible to incorporate other such materials. Examples of these are highly voluminous inorganic carrier materials as described in British patent specifications GB 1 205 711 (Unilever) and GB 1 270 040 (Unilever) and chain structure-type clays as described in EP-A-34 387 (Procter & Gamble).

Some of the materials mentioned above for rheology control also have a subsidiary function, for example as surfactants or detergency builders.

In the case of hard-surface cleaning, the compositions according to the present invention may be formulated as main cleaning agents, or pre-treatment products to be sprayed or wiped on prior to removal, e.g. by wiping off or as part of a main cleaning operation.

In the case of warewashing, the compositions may also be the main cleaning agent or a pre-treatment products, e.g. applied by spray or used for soaking utensils in an aqueous solution and/or suspension thereof.

Those products which are formulated for the cleaning and/or conditioning of fabrics constitute an especially preferred form of the present invention because in that role, there is a very great need to be able to incorporate substantial amounts of various kinds of solids. These compositions may for example, be of the kind used for pre-treatment of fabrics (e.g. for spot stain removal) with the composition neat or diluted, before they are rinsed and/or subjected to a main wash. The compositions may also be formulated as main wash products, being dissolved and/or dispersed in the water with which the fabrics are contacted. In that case, the composition may be the sole cleaning agent or an adjunct to another wash product. Within the context of the present invention, the term 'cleaning composition' also embraces compositions of the kind used as fabric conditioners (including fabric softeners) which are only added in the rinse water (sometimes referred to as 'rinse conditioners').

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

The compositions will be substantially free from agents which are detrimental to the article(s) to be treated. For example, they will be substantially free from pigments or dyes, although of course they may contain small amounts of those dyes (colourants) of the kind often used to impart a pleasing colour to liquid cleaning compositions, as well as fluorescers, bluing agents and the like.

The compositions of the invention contain a non-aqueous liquid phase which is preferably present in an amount of at least 10% by weight of the total composition. The amount of the liquid phase present in the composition may be as high as about 90%, but in most cases the practical amount will lie between 20 and 70% and preferably between 20 and 50% by weight of the composition.

All ingredients before incorporation will either be liquid, in which case, in the composition they will constitute all or part of the non-aqueous liquid phase, or they will be solids, in which case, in the composition they will either be dispersed as solid particles in the liquid phase or they will be dissolved therein. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

Where surfactants are solids, they will usually be dissolved or dispersed in the liquid phase. Where they are liquids, they will usually constitute all or part of the liquid phase. However, in some cases the surfactants may undergo a phase change in the composition. In general, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981.

Liquid surfactants are an especially preferred class of material to use in the liquid phase, especially polyalkoxylated types and in particular polyalkoxylated nonionic surfactants.

When it is desired to incorporate a deflocculant, as a general rule, the most suitable liquids to choose are those having polar molecules. In particular, those comprising a relatively lipophilic part and a relatively hydrophilic part, especially a hydrophilic part rich in electron lone pairs, tend to be well suited. Some liquids are alone, unlikely to be suitable to perform the function of liquid phase if it is desired to incorporate a deflocculant for the solids. However, in that case they still will be able to be incorporated if used with another liquid which does have the required properties, the only requirement being that where the liquid phase comprises two or more liquid components, they are miscible when in the total composition or one can be dispersible in the other, in the form of fine droplets.

Many nonionic detergent surfactants suitable for use in compositions of the present inventions are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and dialkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European patent specification EP-A-225,654 (Unilever), especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (polyglycosides/oligosaccharides) such as described in any of specifications US 3,640,998; US 3,346,558; US 4,223,129; EP-A-92,355; EP-A-99,183; EP-A-70,074, '75, '76, '77; EP-A-75,994, '95, '96.

Nonionic detergent surfactants normally have molecular weights of from about 300 to 11,000.

Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be used include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow.

Yet again, it is also possible to utilise cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g. the sulphobetaines. Combinations of surfactants from within the same, or from different classes may be employed to advantage for optimising structuring and/or cleaning performance.

Non-surfactants which are suitable as the liquid phase include those having molecular forms referred to above as preferred for deflocculation to occur, although other kinds may be used, especially if combined with those of the former type. In general, the non-surfactant liquids can be used alone or with in combination with liquid surfactants. Non-surfactant liquids which have molecular structures which fall into the former, more preferred category include ethers, polyethers, alkylamines and fatty amines, (especially di- and tri-alkyl- and/or fatty-N- substituted amines), alkyl (or fatty) amides and mono- and di- N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Suitable light solvents with little or mo hydrophilic character include lower alcohols, such as ethanol, or higher alcohols, such as dodecanol, as well as alkanes and olefins. Usually, it is preferred to combine them with other liquid materials which are surfactants or non-surfactants having the aforementioned kinds of molecular structure preferred for the occurrence of deflocculation. Even though they may not to play a role in any deflocculation process, it is often desirable to include them for lowering the viscosity of the product and/or assisting soil removal during cleaning.

The compositions according to the present invention may also contain one or more other functional ingredients, for example selected from detergency builders (in addition to the aluminosilicate), bleaches or bleach systems and (for hard surface cleaners) abrasives.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aliminosilicate-type materials, particularly the alkalimetal salt forms. Mixtures of these may also be used.

Examples of phosphorus-containing inorganic builders when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, and metasilicates. Specific examples include sodium carbonate (with or without calcite seeds), potassium carbonate, sodium and potassium bicarbonate and silicates.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphate type sequestering agents such as those sold by Monsanto under the tradename of the Dequest range and alkanehydroxy phosphonates.

Other suitable organic builders include the higher molecular weight polymers and co-polymers known to have burlder properties, for example appropriate polyacrylic acid, polymaleic acid and polyacrylic/-polymaleic acid co-polymers and their salts, such as those sold by BASF under the Sokalan Trade Mark.

Suitable bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with an precursor, or as a peroxy acid compounds.

In the case of the inorganic persalt bleaches, the precursor makes the bleaching more effective at lower temperatures, i.e. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxy bleach compound to the precursor is from about 15:1 to about 2:1, preferably from about 10:1 to about 3.5:1. Whilst the amount of the bleach system i.e. peroxy bleach compound and precursor, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Precursors for peroxybleach compounds have been amply described in the literature, including in British patent specifications 836,988, 855,735, 907,356, 907,358, 907,950, 1,003,310, and 1,246,339, US patent specifications 3,332,882, and 4,128,494, Canadian patent specification 844,481 and South African patent specification 68/6,344.

The exact mode of action of such precursors is not known, but it is believed that peracids are formed by reaction of the precursors with the inorganic peroxy compound, which peracids then liberate active-oxygen by decomposition.

They are generally compound which contain N-acyl or O-acyl residues in the molecule and which exert their activating action on the peroxy compounds on contact with these in the washing liquor.

Typical examples of precursors within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred precursor is N,N,N$^1$,N$^1$-tetra- acetylethylene diamine (TAED).

The organic peroxyacid compound bleaches are preferably those which are solid at room temperature and most preferably should have a melting point of at least 50° C. Most commonly, they are the organic peroxyacids and water-soluble salts thereof having the general formula $$HO-O-\overset{\overset{\displaystyle O}{\|}}{C}-R-Y$$

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution.

Another preferred class of peroxygen compounds which can be incorporated to enhance dispensing/dispersibility in water are the anhydrous perborates described for that purpose in European patent specification EP-A-217,454 (Unilever).

When the compositions contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in the applicants' patent specifications EP-A-50,887; EP-A-80,221; EP-A-140,452; EP-A-214,540 and EP 9,942 (all Unilever), which relate to such abrasives when suspended in aqueous media. Water soluble abrasives may also be used.

The compositions of the invention optionally may also contain one or more minor ingredients such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

In general, the solids content of the product may be within a very wide range, for example from 1%-90%, usually from 10%-80% and preferably from 15%-70%, especially 15%-50% by weight of the final composition. The solid phase should be in particulate form and have an average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus.

The compositions are substantially non-aqueous, i.e. they contain little or no free water, preferably no more than 5%, preferably less than 3%, especially less than 1% by weight of the total composition. It has been found that the higher the water content, the more likely it is for the viscosity to be too high, or even for setting to occur. However, this may at least in part be overcome by use of higher amounts of, or more effective deflocculants or other dispersants.

The present invention will now be illustrated by way of the following examples.

EXAMPLE 1

| Composition: | wt % |
|---|---|
| zeolite | 24 |
| Na perborate monohydrate | 15 |
| TAED (1) | 4 |
| GTA (2) | 5 |
| Dobanol 91/5 (3) | balance |

(1) N,N,N[1],N[1] tetraacetyl ethylene diamine
(2) Glyceryl triacetate
(3) $C_{9-C11}$ fatty alcohol alkoxylated with an average of 5 moles of ethylene oxide per molecule.

Two batches of zeolite were prepared. Type I was zeolite A treated with aqueous ammonium chloride at a concentration to effect an $NH_4^+/Na^+$ ratio of 0.4 whilst type II was prepared with the ratio at 0.8. Both were sub-divided and heated at (a) 130° C., (b) 400° C. The above formulations were then prepared by dispersing the treated zeolite together with other ingredients including dry milled perborate, in the nonionic surfactant followed by treatment in a colloid mill for 5 to 10 minutes. When used in the above formulation, the GTA plus TAED stability was measured by titration at intervals during storage at 37° C. The results were as follows. The figures are expressed as % by weight of the total composition. The titration method measures the peracid generated as a result of precursor breakdown and this is used to back-calculate the degree of breakdown. However because this back-calculation assumes a simplified breakdown mechanism, the calculation may lead to stability figures above 100%. This does not invalidate comparison between different samples. The 'blank' was with untreated zeolite A.

| | Time | | | |
|---|---|---|---|---|
| Zeolite | zero | 1 week | 3 weeks | 4 weeks |
| blank | 8.9 | 5.1 | 5.1 | 2.3 |
| I 400° C. | 9.4 | 10.1 | 9.8 | 9.7 |
| II 400° C. | 9.2 | 9.2 | 9.8 | 8.8 |
| I 130° C. | 9.1 | 8.8 | 8.5 | 8.6 |
| II 130° C. | 9.3 | 9.0 | 7.2 | 5.8 |

EXAMPLE 2

Zeolite A was treated with solutions of ammonium nitrate, chloride and sulphate to generate a desired degree of sodium ion exchange. Using the process described in Example 1, liquid compositions were prepared and tested for precursor stability. Each sample was heated to 130° C. The results were as follows.

| Salt | Exchange (%) | Precursor Stability (% after 28 days) |
|---|---|---|
| None | 0 | 2.4 |
| Nitrate | 5 | 3.1 |
| | 15 | 2.8 |
| | 25 | 3.5 |
| | 35 | 5.1 |
| Chloride | 15 | 5.2 |
| Sulphate | 15 | 5.1 |

These results indicate that both ammonium chloride and ammonium sulphate are at least as effective in reducing decomposition of the precursor as ammonium nitrate.

I claim:

1. A liquid cleaning composition having about 5% by weight or less water comprising a liquid phase having from 1% to 90% by weight of a solid phase having a particle size of from 0.1 to 100 microns dispersed therein, wherein the solid phase comprises aluminosilicate, zeolite builder particles having the general formula $Na_Z(AlO_2)_Z(SiO_2)_Y x H_2O$ wherein Z and Y are integers of at least 6, the molar ratio of Z to Y is in the range from 1.0 to 0.5, and X is an integer from 6 to 189 such that the moisture content is from about 4% to about 20% by weight, which particles have been deactivated by treatment thereof with a solution of an ammonium or substituted ammonium compound such that the molar ratio of ammonium ions to sodium ions in the solution is from about 0.05:1 to about 0.8:1 resulting in a percentage mole exchange of ammonium ions for sodium ions of 1% to 38%, and which particles are thereafter heated to a temperature above 100° C. to reduce the water content thereof to below 24% by weight before being dispersed in the liquid phase.

2. A composition according to claim 1, further comprising from 5% to 35% by weight of an oxygen bleach system comprising an inorganic persalt and a bleach precursor.

3. A composition according to claim 2, wherein said bleach precursor comprises N,N,N$^1$,N$^1$, tetraacetylethylene diamine.

4. A composition according to claim 1, wherein the treated and heated aluminosilicate has a sodium to aluminum molar ratio of less than 1:1, the balance to a molar ratio of 1:1 being made up of ions selected from ammonium ions, substituted ammonium ions and hydronium ions.

5. A composition according to claim 4, wherein said sodium to aluminum ratio is from 0.99.to 0.62:1.

6. A composition according to claim 1, wherein said aluminosilicate particles have a water content of not more than 18% by weight.

7. A process for preparing a liquid cleaning composition having about 5% by weight or less water, comprising the steps of:

(a) treating aluminosilicate, zeolite builder particles having the general formula $Na_Z(AlO_2)_Z(SiO_2)_Y x H_2O$ wherein Z and Y are integers of at least 6, the molar ratio of Z to Y is in the range from 1.0 to 0.5, and X is an integer from 6 to 189 such that the moisture content is from about 4% to about 20% by weight, which particles have a particle size of from 0.1 to 100 microns with a solution of an ammonium or substituted ammonium compound such that the molar ratio of ammonium ions to sodium ions in the solution is from about 0.05:1 to about 0.8:1 resulting in a percentage mole exchange of ammonium ions for sodium ions of 1% to 38%; and thereafter (b) heating the treated aluminosilicate particles to a temperature above 100° C. to reduce the water content thereof to below 24% by weight; and (c) dispersing the treated particles at a concentration of from 1% to 90% by weight in a non-aqueous liquid.

8. A process according to claim 7, wherein in step (a), said ammonium compound is selected from ammonium and quaternary ammonium salts with an inorganic or organic anion.

9. A process according to claim 7, wherein said ammonium compound is selected from ammonium nitrate, ammonium chloride and ammonium sulphate.

10. A process according to claim 7, wherein step (a) comprises contacting said aluminosilicate particles with a solution of the ammonium or substituted ammonium compound in a suitable solvent.

11. A process according to claim 10, wherein step (a) is followed by washing with water and then, before or simultaneously with step (b), drying.

12. A process according to claim 7, wherein step (b) comprises heating said treated aluminosilicate particles to a temperature of from 400° C. to 450° C.

13. A process according to claim 7, wherein step (b) comprises heating said treated aluminosilicate particles to a temperature of from 150° C. to 200° C.

14. A process according to claim 8, wherein step (b) comprises heating said treated aluminosilicate particles to reduce the water content thereof to not more than 18% by weight.

15. A process according to claim 7, wherein simultaneously with or following step (c) further components are dispersed in the composition.

16. A process according to claim 15, wherein said further components comprise components sensitive to catalytic decomposition.

17. A process according to claim 15, wherein said further components comprise solid phase ingredients and following their dispersion in the composition, said solid phase ingredients are at least partly size reduced by milling.

* * * * *